US011833635B2

(12) United States Patent
Fujii et al.

(10) Patent No.: US 11,833,635 B2
(45) Date of Patent: Dec. 5, 2023

(54) POLISHING SYSTEM, LEARNING DEVICE, AND LEARNING METHOD OF LEARNING DEVICE

(71) Applicant: Panasonic Intellectual Property Management Co., Ltd., Osaka (JP)

(72) Inventors: Keitaro Fujii, Osaka (JP); Masayuki Takahashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 963 days.

(21) Appl. No.: 16/774,010

(22) Filed: Jan. 28, 2020

(65) Prior Publication Data

US 2020/0262023 A1 Aug. 20, 2020

(30) Foreign Application Priority Data

Feb. 19, 2019 (JP) ..... 2019-027271

(51) Int. Cl.

| | |
|---|---|
| ***B24B 37/005*** | (2012.01) |
| ***B24B 37/04*** | (2012.01) |
| ***B24B 49/16*** | (2006.01) |
| ***B24B 49/14*** | (2006.01) |
| ***B24B 49/10*** | (2006.01) |
| ***B24B 37/10*** | (2012.01) |

(52) U.S. Cl.

CPC ..... *B24B 37/005* (2013.01); *B24B 37/042* (2013.01); *B24B 37/105* (2013.01); *B24B 49/10* (2013.01); *B24B 49/14* (2013.01); *B24B 49/16* (2013.01)

(58) Field of Classification Search

CPC ... B24B 37/005; B24B 37/013; B24B 37/015; B24B 37/042; B24B 37/105; B24B 49/10; B24B 49/14; B24B 49/16

See application file for complete search history.

(56) References Cited

U.S. PATENT DOCUMENTS 5,774,833 A * 6/1998 Newman ..... G06F 40/211 704/9
5,809,699 A * 9/1998 Joly ..... A62C 2/10 160/1
5,813,002 A * 9/1998 Agrawal ..... G06F 16/00 707/999.005
5,818,714 A * 10/1998 Zou ..... G05B 13/042 700/39
5,822,220 A * 10/1998 Baines ..... G05D 21/02 706/3

(Continued)

FOREIGN PATENT DOCUMENTS

JP 2000-286218 10/2000
JP 2007-266507 10/2007

(Continued)

*Primary Examiner* — David B. Thomas
(74) *Attorney, Agent, or Firm* — Wenderoth, Lind & Ponack, L.L.P.

(57) ABSTRACT

A learning device includes a learning unit that executes learning of determining a corrected polishing condition by updating an action value function based on state information including at least one polishing condition and a calculation result calculated based on at least one measured value during polishing.

7 Claims, 10 Drawing Sheets

(56) References Cited

U.S. PATENT DOCUMENTS 5,828,812 A * 10/1998 Khan ..... G06N 3/043 706/900
5,830,955 A * 11/1998 Takeda ..... C08F 10/00 526/60
5,832,466 A * 11/1998 Feldgajer ..... G06N 3/086 706/15
5,832,468 A * 11/1998 Miller ..... G05B 13/027 706/23
5,841,651 A * 11/1998 Fu ..... G06N 3/043 216/60
5,841,671 A * 11/1998 Furumoto ..... D21G 9/0018 162/253
5,978,398 A * 11/1999 Ramdani ..... H01S 5/183 372/45.01
6,568,989 B1 * 5/2003 Molnar ..... B24B 37/042 451/41
6,749,714 B1 6/2004 Ishikawa et al.
6,878,038 B2 * 4/2005 Johansson ..... B24B 49/04 451/6
7,008,300 B1 * 3/2006 Molnar ..... H01L 22/10 451/6
7,024,268 B1 * 4/2006 Bennett ..... G05B 19/41875 451/6
7,131,890 B1 * 11/2006 Molnar ..... H01L 21/67288 439/690
7,354,332 B2 * 4/2008 Surana ..... B24B 49/10 451/6
7,377,836 B1 * 5/2008 Molnar ..... B24B 37/013 438/692
7,575,501 B1 * 8/2009 Molnar ..... G05B 19/41875 702/182
8,357,286 B1 * 1/2013 Molnar ..... B24B 37/005 216/84
10,795,346 B2 * 10/2020 Yennie ..... B24B 37/013
10,969,773 B2 * 4/2021 Yennie ..... G06N 3/084
11,331,764 B2 * 5/2022 Nakamura ..... B24B 37/042
11,376,704 B2 * 7/2022 Nakamura ..... B24B 37/042
11,524,382 B2 * 12/2022 Xu ..... H01L 21/67253
11,565,365 B2 * 1/2023 Wang ..... B24B 57/02
11,571,786 B2 * 2/2023 Osterheld ..... G06N 3/084
11,577,356 B2 * 2/2023 Cherian ..... G06N 3/084
11,583,973 B2 * 2/2023 Shinozaki ..... B24B 37/042
2008/0200032 A1 8/2008 Ashizawa et al.
2012/0058709 A1 3/2012 Fukushima et al.
2017/0031328 A1 2/2017 Sawada et al.
2018/0207768 A1 7/2018 Shibuya et al.
2019/0168355 A1 * 6/2019 Suzuki ..... H01L 21/304
2019/0240804 A1 * 8/2019 Zhang ..... G06N 20/00
2019/0286075 A1 * 9/2019 Yennie ..... G05B 19/4188
2019/0286111 A1 * 9/2019 Yennie ..... H01L 21/67253
2020/0101579 A1 * 4/2020 Suzuki ..... G06N 3/08
2020/0269381 A1 * 8/2020 Shinozaki ..... B24B 37/10
2021/0018902 A1 * 1/2021 Yennie ..... H01L 21/30625
2021/0370461 A1 * 12/2021 Kamiki ..... B24B 37/005
2022/0072679 A1 * 3/2022 Maruyama ..... G16Y 20/10
2022/0093409 A1 * 3/2022 Namiki ..... G06F 17/15
2022/0168864 A1 * 6/2022 Kato ..... G06N 20/00

FOREIGN PATENT DOCUMENTS

JP 2008-205464 9/2008
JP 2012-056011 3/2012
JP 2012-074574 4/2012
JP 2017-030067 2/2017
JP 2018-058197 4/2018
JP 2018-118372 8/2018

* cited by examiner

When pad chocking occurs

When pad clogging occurs

POLISHING SYSTEM, LEARNING DEVICE, AND LEARNING METHOD OF LEARNING DEVICE

BACKGROUND

1. Technical Field

The present disclosure relates to a polishing system, a learning device, and a learning method of the learning device.

2. Description of the Related Art

In the related art, in CMP (Chemical Mechanical Polishing), which is a kind of polishing, a mechanical polishing technology is known in which the polishing is executed on a workpiece by supplying slurry onto a polishing pad and interposing the slurry between the workpiece and the polishing pad, while rotating and pressing the workpiece with a polishing head, for the polishing pad generally affixed on a surface plate, and which is mainly used for a polishing process of semiconductor board components.

This polishing process is a process in which the workpiece is easily processed by a chemical action of the slurry and the workpiece is polished by the action of the abrasive grains. Even now, generally, it is an unstable process that generally polishes the workpiece based on an estimated polishing rate based on empirical rules such as Preston's law (or Preston equation).

In addition, in the polishing process, since the workpiece is always interposed between the polishing pad and the polishing head, it is difficult to measure a state of a process during polishing and it is difficult to execute feedback adjustment during the polishing, and since a state of the process also changes during the polishing due to a change in the state of a surface of the polishing pad, it is difficult to control the process.

For example, in Japanese Patent Unexamined Publication No. 2018-118372, a technology is disclosed in which a dressing condition for a polishing pad, surface property measurement data of a polishing pad, and polishing result data are input to a neural network, and a correlation of each data is calculated and learned according to a predetermined program. According to this technology, estimated dressing condition data at the time of dressing the surface of the polishing pad is calculated, and an operator executes dressing on the polishing pad by driving a dressing unit based on the estimated dressing condition data.

SUMMARY

A polishing system of the disclosure includes a polishing device that applies a load by a polishing head to a workpiece on a polishing pad of a surface plate, supplies slurry onto the polishing pad, and executes polishing on the workpiece by rotating each of the surface plate and the polishing head, and a learning device that corrects the polishing executed by the polishing device through learning, in which in the learning device, a state information receiving unit that receives state information including (i) at least one polishing condition relating to the polishing, and (ii) a calculation result calculated based on at least one measured value measured during execution of the polishing, a learning unit that updates, based on the state information during the polishing, an action value function in which the state information and a corrected polishing condition for correcting the polishing condition are associated with each other, and a determination unit that determines the corrected polishing condition corresponding to the state information during the polishing, based on the action value function updated by the learning unit, are included.

In addition, a learning device of the disclosure that corrects, through learning, polishing on a workpiece executed by a polishing device by applying a load by a polishing head to the workpiece on a polishing pad of a surface plate, supplying slurry onto the polishing pad, and rotating each of the surface plate and the polishing head includes a state information receiving unit that receives state information including (i) at least one polishing condition relating to the polishing, and (ii) a calculation result calculated based on at least one measured value measured during execution of the polishing, a learning unit that updates an action value function in which the state information and a corrected polishing condition for correcting the polishing condition are associated with each other, based on the state information during the polishing, and a determination unit that determines the corrected polishing condition corresponding to the state information during the polishing, based on the action value function updated by the learning unit.

In addition, a learning method of a learning device of the disclosure that corrects, through learning, polishing on a workpiece executed by a polishing device by applying a load by a polishing head to the workpiece on a polishing pad of a surface plate, supplying slurry onto the polishing pad, and rotating each of the surface plate and the polishing head includes receiving state information including (i) at least one polishing condition relating to the polishing, and (ii) a calculation result calculated based on at least one measured value measured during execution of the polishing, updating an action value function in which the state information and a corrected polishing condition for correcting the polishing condition are associated with each other, based on the state information during the polishing, and determining the corrected polishing condition corresponding to the state information during the polishing, based on the updated action value function.

DETAILED DESCRIPTION

In the technology of Japanese Patent Unexamined Publication No. 2018-118372, it is difficult to evaluate a state of a polishing process based on real-time data generated during the polishing process on a workpiece and correct the polishing process based on this evaluation.

An object of the disclosure is to stabilize the polishing process by evaluating the state of the polishing process based on the real-time data generated during the polishing on the workpiece.

Hereinafter, the embodiment of the disclosure will be described with reference to the drawings.

(For Polishing System)

Figure 1:
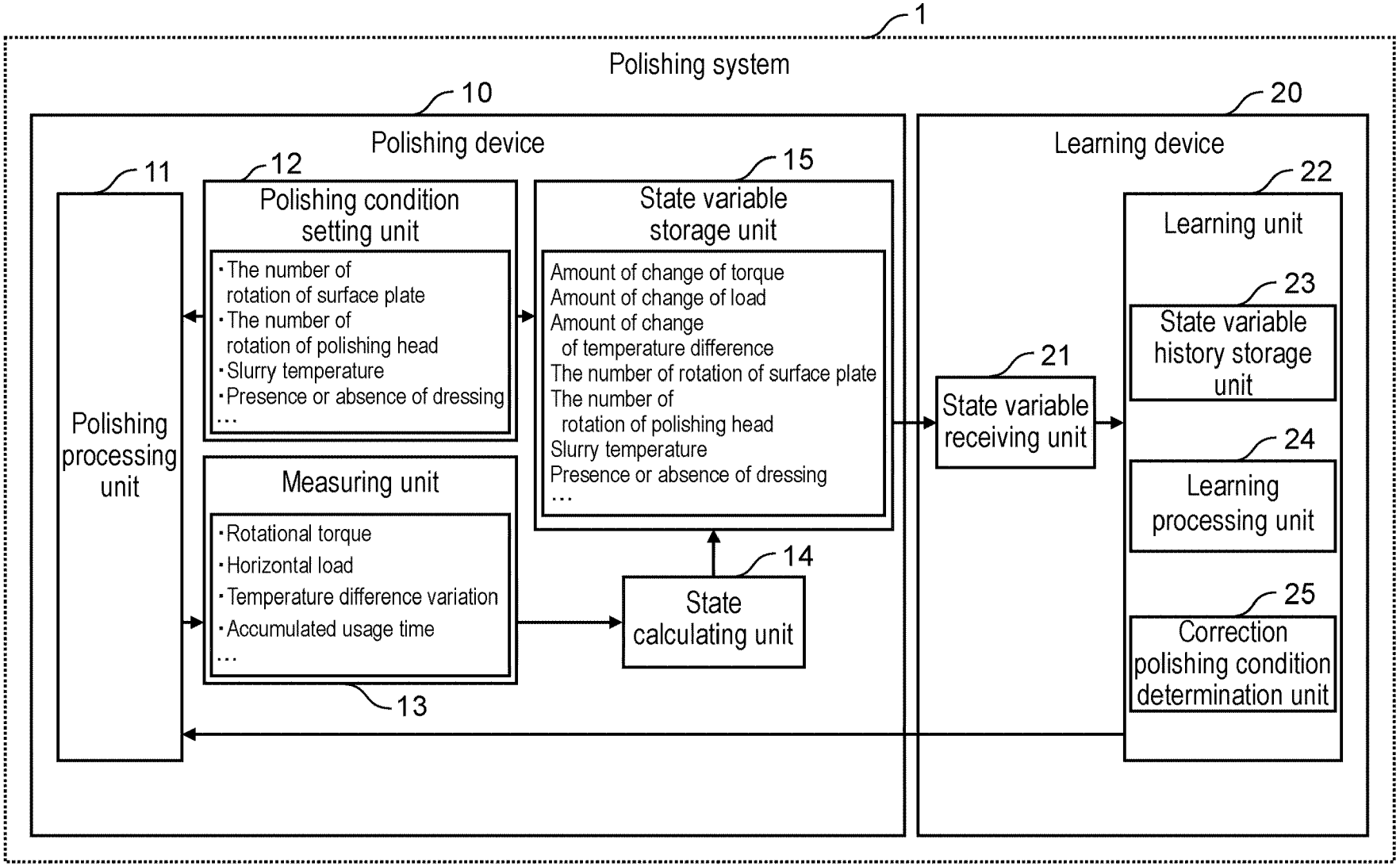
FIG. 1 is a diagram showing a configuration of a polishing system according to an embodiment of the disclosure.

FIG. 1 is a diagram showing a configuration of a polishing system according to an embodiment of the disclosure.

Polishing system 1 is configured with polishing device 10 that executes polishing on the workpiece and learning device 20 that executes reinforcement learning by state variables from polishing device 10.

In FIG. 1 and the following description, illustration and description of an input and output interface and the like will be omitted.

(For Polishing Device)

Polishing device 10 is configured with polishing processing unit 11, polishing condition setting unit 12, measuring unit 13, state calculating unit 14, and state variable storage unit 15.

Polishing processing unit 11 is for executing chemical mechanical polishing (hereinafter, referred to as polishing) of the surface of the workpiece, and since it is a known technology, detailed description thereof is omitted.

In polishing processing unit 11, a torque detection sensor (not shown) for detecting the rotational torque of a polishing head during the polishing on the surface of the workpiece, a load detection sensor (not shown) for detecting load in a horizontal direction applied to the polishing head during the polishing on the surface of the workpiece, a first temperature detection sensor (not shown) for detecting temperature of the inner circumference side of the polishing head during the polishing on the surface of the workpiece, a second temperature detection sensor (not shown) for detecting temperature of the outer circumference side of the polishing head during the polishing on the surface of the workpiece, a first rotation number detection sensor (not shown) for detecting the number of rotation of the surface plate, a second rotation number detection sensor (not shown) for detecting the number of rotation of the polishing head, and the like are provided, and detection data detected by each of these sensors is input to measuring unit 13.

In addition, from polishing processing unit 11 to measuring unit 13, various data are transmitted, such as polishing start data indicating the start of polishing, polishing completion data indicating the end of polishing, temperature data of slurry, and part replacement data indicating that various parts such as a polishing pad are replaced, and error data indicating various errors generated in polishing processing unit 11.

Polishing condition setting unit 12 is for setting polishing condition data for the workpiece to be polished in polishing processing unit 11. In addition, the polishing condition data set in polishing processing unit 11 is output to state variable storage unit 15.

For example, as the polishing condition data set from polishing condition setting unit 12 to polishing processing unit 11, there are the number of rotation of the surface plate, the number of rotation of the polishing head, slurry temperature, the presence or absence of dressing, and the like. The polishing condition data of the workpiece is set by being input by an operator, a polishing system central management computer (not shown), or the like.

Measuring unit 13 is for executing various measurements on polishing processing unit 11 during the polishing.

Measuring unit 13 receives the detection data from each of the above-described detection sensors and various data. Measuring unit (torque measuring unit) 13 measures the rotational torque of a polishing head from the start of polishing of the surface of the workpiece to the end of polishing every unit time, by receiving torque data detected by the torque detection sensor which is an example of the torque measuring unit. In addition, measuring unit (load measuring unit) 13 measures the load in the horizontal direction applied to the polishing head from the start of polishing of the surface of the workpiece to the end of polishing every unit time, by receiving load data detected by the load detection sensor which is an example of the load measuring unit. Rotational torque data indicating the measured rotational torque and horizontal load data indicating the load in the horizontal direction are transmitted to state calculating unit 14.

In addition, measuring unit (temperature measuring unit) 13 measures the temperature of the inner circumference side and the temperature of the outer circumference side, every unit time, for an elapsed time from the start of polishing of the surface of the workpiece to the end of polishing, by receiving temperature data of the inner circumference side of the polishing head detected by the first temperature detection sensor which is an example of the temperature measuring unit and the temperature data of the outer circumference side of the polishing head detected by the second temperature detection sensor. Inner circumference side temperature data indicating the temperature of the inner circumference side and outer circumference side temperature data indicating the temperature of the outer circumference side which are measured are transmitted to state calculating unit 14.

In addition, measuring unit (time measuring unit) 13, which is an example of the time measuring unit, resets an accumulated usage time for the polishing pad before exchange by receiving exchange data indicating that the polishing pad is exchanged, and measures (counts) the accumulated usage time by a new polishing pad. Accumulated usage time data indicating the measured accumulated usage time is transmitted to state calculating unit 14.

In addition, measuring unit 13 measures the number of rotation of the surface plate and the number of rotation of the polishing head every unit time during the polishing, by receiving rotation number data of the surface plate detected by the first rotation number detection sensor and the rotation number data of the polishing head detected by the second rotation number detection sensor. The rotation number data of the surface plate indicating the measured rotation number of the surface plate and the rotation number data of the polishing head indicating the number of rotation of the polishing head are transmitted to state calculating unit 14.

State calculating unit 14 receives various measurement data from the above-described measuring unit 13, and calculates to update the amount of various changes within a set time (for example, sample processing time will be described below with reference to FIG. 6). The calculated amount of change as change amount data is output to state variable storage unit 15, and stored in state variable storage unit 15 as state variables.

When the rotational torque data is received, state calculating unit 14 calculates the amount of change of the rotational torque of the polishing head within the set time. In addition, when the horizontal load data is received, the amount of change of the horizontal load of the polishing head is calculated within the set time. In addition, when the inner circumference side temperature data and the outer circumference side temperature data are received, an absolute value of the temperature difference between the inner circumference side and the outer circumference side of the polishing head is calculated within the set time. State calculating unit 14 calculates the amount of change of the temperature difference between the inner circumference side and the outer circumference side of the polishing head within the set time, based on the calculated absolute value of the temperature difference. When surface plate rotation number data or the polishing head rotation number data are received, state calculating unit 14 calculates the difference between an actual measured value and a set value of the number of rotation of the surface plate or the polishing head within the set time. State calculating unit 14 outputs each of the calculated amount of change as the change amount data to state variable storage unit 15. In addition, state calculating unit 14 outputs the calculated absolute value data of the temperature difference, difference data of the number of rotation of the surface plate, and the difference data of the number of rotation of the polishing head to state variable storage unit 15. Furthermore, state calculating unit 14 outputs the accumulated usage time data measured by measuring unit 13 to state variable storage unit 15.

State variable storage unit 15 stores the change amount data of the rotational torque of the polishing head, the change amount data of the horizontal load of the polishing head, the absolute value data and the change amount data of the temperature difference between the inner circumference side and the outer circumference side of the polishing head, the difference data of the number of rotation of the surface plate and the polishing head, the accumulated usage time data, and the like output from the above-described state calculating unit 14, and the polishing condition data (the number of rotation of surface plate, the number of rotation of the polishing head, polishing load, slurry temperature, slurry pH, slurry flow rate, processing time, type of polishing pad, presence or absence of dressing, and the like) output from the above-described polishing condition setting unit 12 as state variables (state data). When a new state variable is received, state variable storage unit 15 transmits the received state variable to a learning device 20. The transmitted state variable is received by state variable receiving unit 21 of learning device 20. Each configuration included in polishing device 10 may be present independently. In this case, it is preferable that components are connected wirelessly or by a wire to exchange data and the like. For example, polishing processing unit 11 is a device for executing general chemical mechanical polishing, polishing condition setting unit 12 is a device having an input function such as a touch panel and a keyboard, and state calculating unit 14 and state variable storage unit 15 are computers having a CPU.

(For Learning Device)

Learning device 20 corrects the polishing executed by polishing device 10 by learning. Learning device 20 is configured with state variable receiving unit 21 and learning unit 22.

State variable receiving unit (state information receiving unit) 21 receives the state variable transmitted from the above-described state variable storage unit 15 and transmits the received result to learning unit 22. That is, state variable receiving unit 21 receives state information including at least one polishing condition relating to polishing and a calculation result calculated based on at least one measured value measured during the execution of the polishing.

Learning unit 22 is configured with state variable history storage unit 23, learning processing unit 24, and correction polishing condition determination unit 25.

State variable history storage unit 23 stores the state variable transmitted from the above-described state variable receiving unit 21 as the history data of the state variable. Each of the state variables (change amount data of rotational torque of polishing head, change amount data of horizontal load of polishing head, change amount data of temperature difference between inner circumference side and outer circumference side of polishing head, the number of rotation of surface plate, the number of rotation of polishing head, slurry temperature, presence or absence of dressing, and the like) is stored in association with the reception date and time. That is, the state variables include at least one polishing condition (the number of rotation of surface plate, the number of rotation of polishing head, slurry temperature, presence or absence of dressing, and the like) relating to the polishing, and a calculation result (change amount data of rotational torque of polishing head, change amount data of horizontal load of polishing head, absolute value data and change amount data of temperature difference between inner circumference side and outer circumference side of polishing head, difference data of the number of rotation of surface plate and polishing head, accumulated usage time data, and the like) calculated based on at least one measured value measured during the execution of the polishing.

Learning processing unit (learning unit) 24 updates to optimize an action value function by a Q-learning method by appropriately using the history data of the state variable stored in the above-described state variable history storage unit 23. That is, learning processing unit 24 updates the action value function in which the state information is associated with the corrected polishing condition for correcting the polishing condition based on the state information during the polishing. The description of a learning process executed by learning processing unit 23 will be described below by using FIG. 6, FIG. 7, and FIG. 8.

Correction polishing condition determination unit (determination unit) 25 determines the corrected polishing condition that is a condition for correcting the current polishing condition, based on the state variable transmitted from the above-described state variable receiving unit 21 and the action value function optimized by learning processing unit 24. In other words, correction polishing condition determination unit 25 determines the corrected polishing condition corresponding to the state variables during the polishing, based on the action value function updated by learning processing unit 24. In correction polishing condition determination unit 25, a condition correction model for determining the corrected polishing condition is registered, and the corrected polishing condition with high accuracy can be determined by applying the action value function optimized by the above-described learning processing unit 24. The determined corrected polishing condition is transmitted to polishing processing unit 11 of the above-described polishing device 10.

Here, in the polishing system according to the present embodiment, as the above-described state variables, the basis for dealing with the amount of change of the rotational torque of the polishing head, the amount of change of the horizontal load of the polishing head, and the amount of change of the temperature difference between the inner circumference side and the outer circumference side of the polishing head will be described by using FIG. 2 to FIG. 5.

(Relationship Between Rotational Torque of Polishing Head and Polishing Time)

Figure 2A:
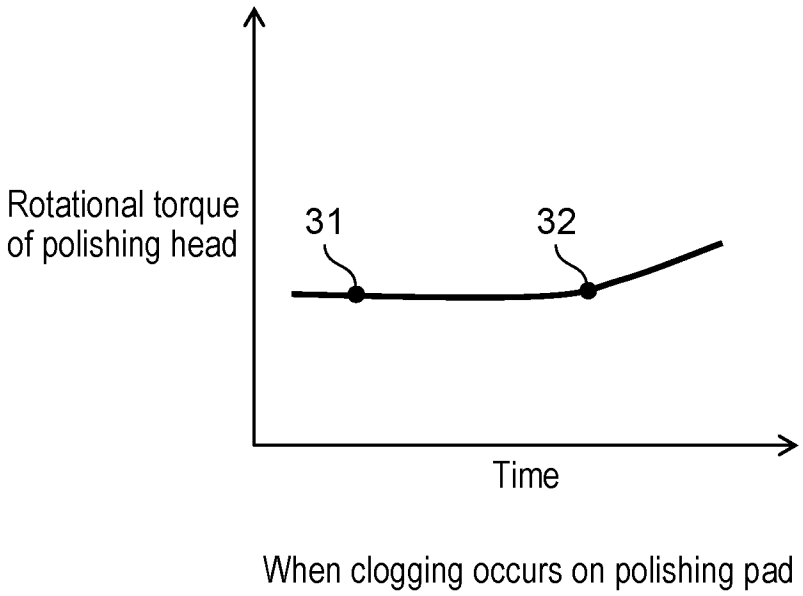
FIG. 2A is a graph showing relationship between rotational torque of a polishing head and a polishing time during polishing according to the embodiment of the disclosure.
Figure 2B:
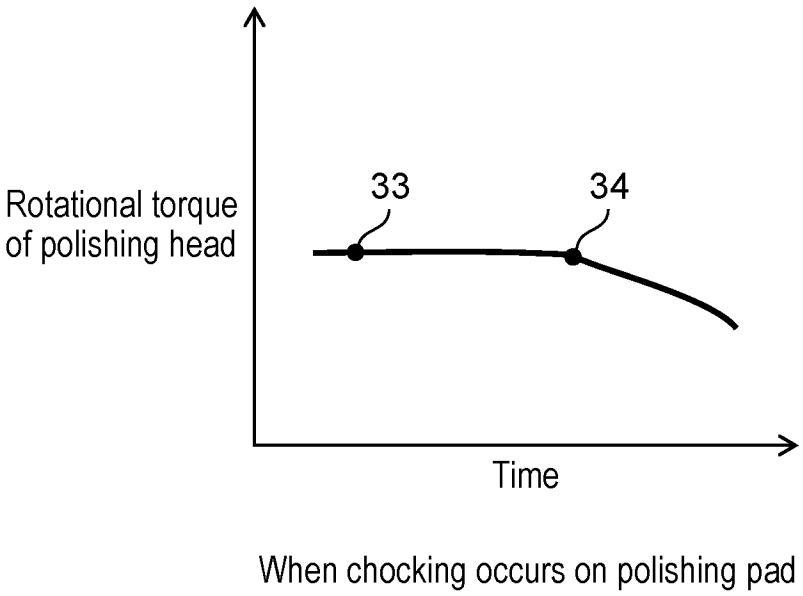
FIG. 2B is another graph showing a relationship between the rotational torque of a polishing head and the polishing time during the polishing according to the embodiment of the disclosure.

FIGS. 2A and 2B, are graphs showing the relationship between the rotational torque and the polishing time of the polishing head during the polishing on the surface of the workpiece.

FIG. 2A is a graph showing a case where clogging occurs on the polishing pad, and FIG. 2B is a graph showing a case where chocking occurs on the polishing pad.

In general, when the clogging occurs or chocking occurs on the polishing pad, it is known that the rotational torque of the polishing head changes due to a change in the coefficient of friction between the polishing pad and the workpiece as compared with the normal state.

First, with reference to FIG. 2A, a case where the clogging on the polishing pad will be described. As shown in FIG. 2A, when the clogging occurs on the polishing pad, the rotational torque of the polishing head is a value of normal rotational torque (normal rotational torque range) in the range of time 31 to time 32, but the rotational torque gradually increases after time 32. This is because a friction coefficient between the surface of the workpiece and the polishing pad increases by acting the clogging generated on the polishing pad as a resistance against the rotation of the polishing head.

Next, a case where the chocking occurs on the polishing pad will be described with reference to FIG. 2B. As shown in FIG. 2B, when the chocking occurs on the polishing pad, the rotational torque of the polishing head is a value of normal rotational torque (normal rotational torque range) in the range of time 33 to time 34, but the rotational torque gradually decreases after time 34. This is because the friction coefficient between the surface of the workpiece and the polishing pad decreases by decreasing a contact region between the surface of the workpiece and the polishing pad by the chocking that occurs on the polishing pad.

As described above, when there is a change in the rotational torque of the polishing head during the polishing on the surface of the workpiece, there is a high possibility that the clogging or chocking occurs on the polishing pad. Therefore, in this embodiment, an evaluation result obtained by evaluating the amount of change in the rotational torque of the polishing head is immediately fed back to polishing processing unit 11 of polishing device 10. When the clogging or the chocking occurs on the polishing pad, a solution to this problem is to execute dressing on the polishing pad.

(Relationship Between Horizontal Load and Polishing Time Applied to Polishing Head)

Figure 3B:
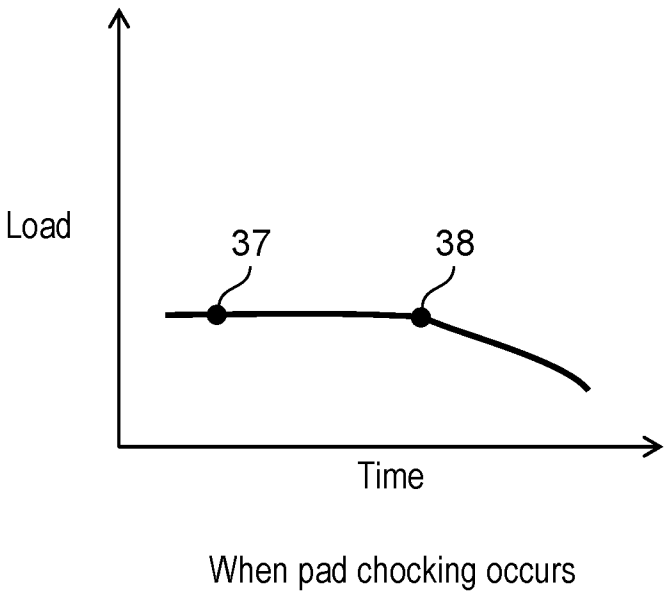
FIG. 3B is another graph showing a relationship between a horizontal load and the polishing time on the polishing head during the polishing according to the embodiment of the disclosure.
Figure 3A:
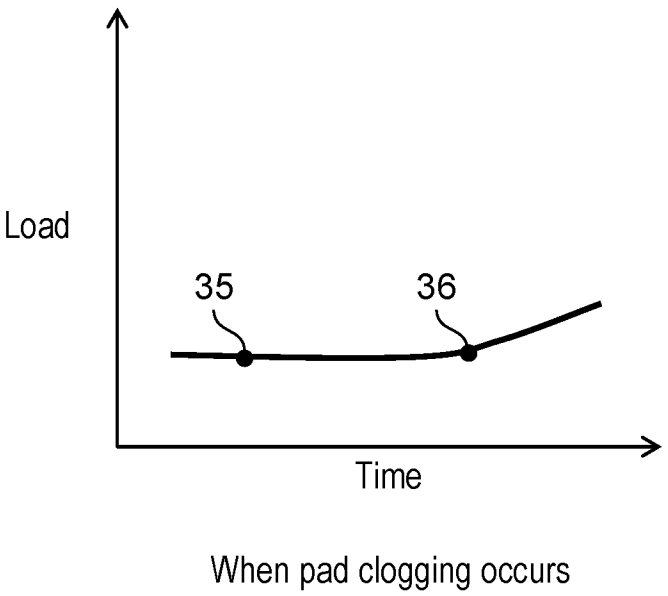
FIG. 3A is a graph showing a relationship between a horizontal load and the polishing time on the polishing head during the polishing according to the embodiment of the disclosure.

FIGS. 3A and 3B are graphs showing a relationship between the horizontal load and the polishing time applied to the polishing head during the polishing on the surface of the workpiece.

FIG. 3A is a graph showing the case where the clogging occurs on the polishing pad, and FIG. 3B is a graph showing the case where the chocking occurs on the polishing pad.

In general, when the clogging or chocking occurs on the polishing pad, it is known that the horizontal load of the polishing head changes due to a change of the friction coefficient between the polishing pad and the workpiece as compared with the normal state.

First, with reference to FIG. 3A, the case where the clogging occurs on the polishing pad will be described. As shown in FIG. 3A, when the clogging occurs on the polishing pad, the horizontal load applied to the polishing head increases from time 35, which is a value of a normal load (normal load range), to time 36 and thereafter. This is because the friction coefficient between the surface of the workpiece and the polishing pad increases by acting the clogging generated on the polishing pad as a resistance against the rotation of the polishing head.

Next, with reference to FIG. 3B, the case where the chocking occurs on the polishing pad will be described. As shown in FIG. 3B, when the chocking occurs on the polishing pad, since the horizontal load applied to the polishing head decreases from time 37, which is a value of the normal load (normal load range), to time 38 and thereafter, rotational torque decreases. This is because the friction coefficient between the surface of the workpiece and the polishing pad decreases by decreasing a contact region between the surface of the workpiece and the polishing pad by the chocking that occurs on the polishing pad.

As described above, when there is a change in the horizontal load applied to the polishing head during the polishing on the surface of the workpiece, there is a high possibility that the clogging or chocking occurs on the polishing pad. Therefore, in this embodiment, an evaluation result obtained by evaluating the amount of change of the horizontal load applied to the polishing head is immediately fed back to polishing processing unit 11 of polishing device 10. When the clogging or the chocking occurs on the polishing pad, a solution to this problem is to execute dressing on the polishing pad.

(Relationship Between Temperature Difference of Inner Circumference Side and Outer Circumference Side of Polishing Head and Polishing Time)

Figure 4:
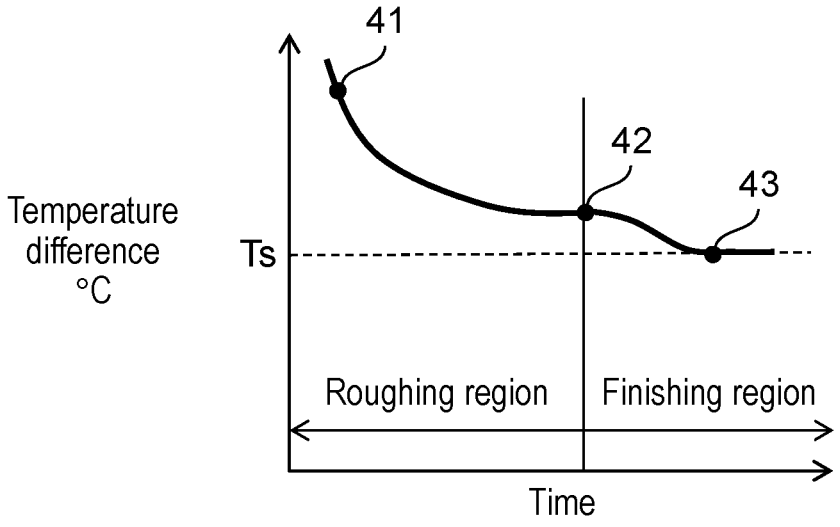
FIG. 4 is a graph showing a relationship between temperature difference in an inner circumference side and an outer circumference side of the polishing head and the polishing time during the polishing according to the embodiment of the disclosure.

FIG. 4 is a graph showing a relationship between the temperature difference in the inner circumference side and the outer circumference side of the polishing head, and the polishing time during the polishing on the surface of the workpiece.

Originally, the purpose of the polishing is to flatten the workpiece having thickness variations. Normally, in pressure applied to the workpiece, since the pressure applied to a thick part is higher than that of a thin part of the workpiece, the workpiece is polished quickly. That is, the polishing process is a process that executes automatically flattening in accordance with the thickness variation of the workpiece. However, actually, this is not the case, and the flattening is devised to achieve the polishing process.

Therefore, in the present embodiment, by dividing the polishing process into two processes on a roughing region (roughing process) in which a thick part of the workpiece is actively removed and a finishing region (finishing process) in which flattening is executed by pressure distribution due to thickness variation of the workpiece, the shortening of the polishing time and high flattening are realized.

Here, in order to that the polishing process is divided into two processes of the roughing process and the finishing process, a method for evaluating the pressure distribution of the polishing rate and the thickness variation of the workpiece is considered. From Preston's law, it is considered that the polishing rate is proportional to the pressure applied to the workpiece and the relative speed between the workpiece and the polishing pad. Among them, a parameter that greatly changes during the polishing is the pressure applied to the workpiece that changes due to the thickness variation of the workpiece.

On the other hand, processing heat generated during the polishing is roughly divided into two types of heat generated by friction between the polishing pad and the workpiece, and heat generated by chemical reaction between the slurry and the workpiece. Among them, friction heat due to the friction occupies most. The friction heat increases in proportion to friction coefficient, pressure, relative speed, and sliding time, but, among these parameters, the parameter that changes greatly during the polishing is the pressure as described above.

Therefore, in the processing heat that occurs during the polishing, by evaluating a change in the temperature difference between the inner circumference side and the outer circumference side of the polishing head, which is a propagation destination of the processing heat, it is possible to evaluate the pressure distribution of the polishing rate and a change in the thickness variation of the workpiece.

With reference to FIG. 4, at time 41, which is a time shortly after the start of polishing in the roughing region, the temperature difference between the inner circumference side and the outer circumference side of the polishing head increases by the magnitude of the pressure distribution due to the large thickness variation of the workpiece. The temperature difference changes according to changes in the thickness variation of the workpiece unless the polishing condition is changed greatly. As the surface of the workpiece becomes flat, the temperature difference between the inner circumference side and the outer circumference side of the polishing head becomes smaller. Therefore, at time 42, which is the time when the change in the temperature difference is converged, since the change in the pressure distribution is converged, that is, the workpiece is flattened to some extent, the roughing region completes. That is, in the roughing region, it is possible to realize the shortening of the polishing time by quickly converging the temperature difference between the inner circumference side and the outer circumference side of the polishing head.

Time 42, which is the time when the change of the temperature difference is converged, and thereafter is the finishing region, and, basically, it is ideal that the polishing is executed so that the temperature difference is constant at 0 and automatic flattening is executed due to thickness variation of the workpiece. However, since the slurry supplied on the polishing pad flows in from the outer circumference side of the workpiece and moves toward the center of the workpiece, a cooling effect by the slurry becomes non-uniform on the surface and temperature distribution occurs on the surface of the workpiece. The polishing rate is also affected by temperature, and the higher the temperature, the higher the polishing rate. Therefore, the distribution of the polishing rate occurs on the outer circumference side and the center side of the workpiece. In addition, on the other hand, since the processing temperature of the surface of the workpiece is passed through the polishing pad until it is transmitted to the polishing head, even if the temperature distribution of the polishing head is made uniform, the temperature distribution on the surface of the workpiece is not always uniform.

Therefore, the temperature difference between the inner circumference side and the outer circumference side of the polishing head is set to the temperature difference $T_S$ so as to be optimal for flattening of the workpiece, and the high flattening of the workpiece can be realized by maintaining the temperature difference in the polishing head in the vicinity of $T_S$ at time 43 and thereafter.

(Relationship of Difference of Friction Distance Between Outer Circumference Side and Center Side of Workpiece, and Difference in the Number of Rotation Between Surface Plate and Polishing Head)

Figure 5:
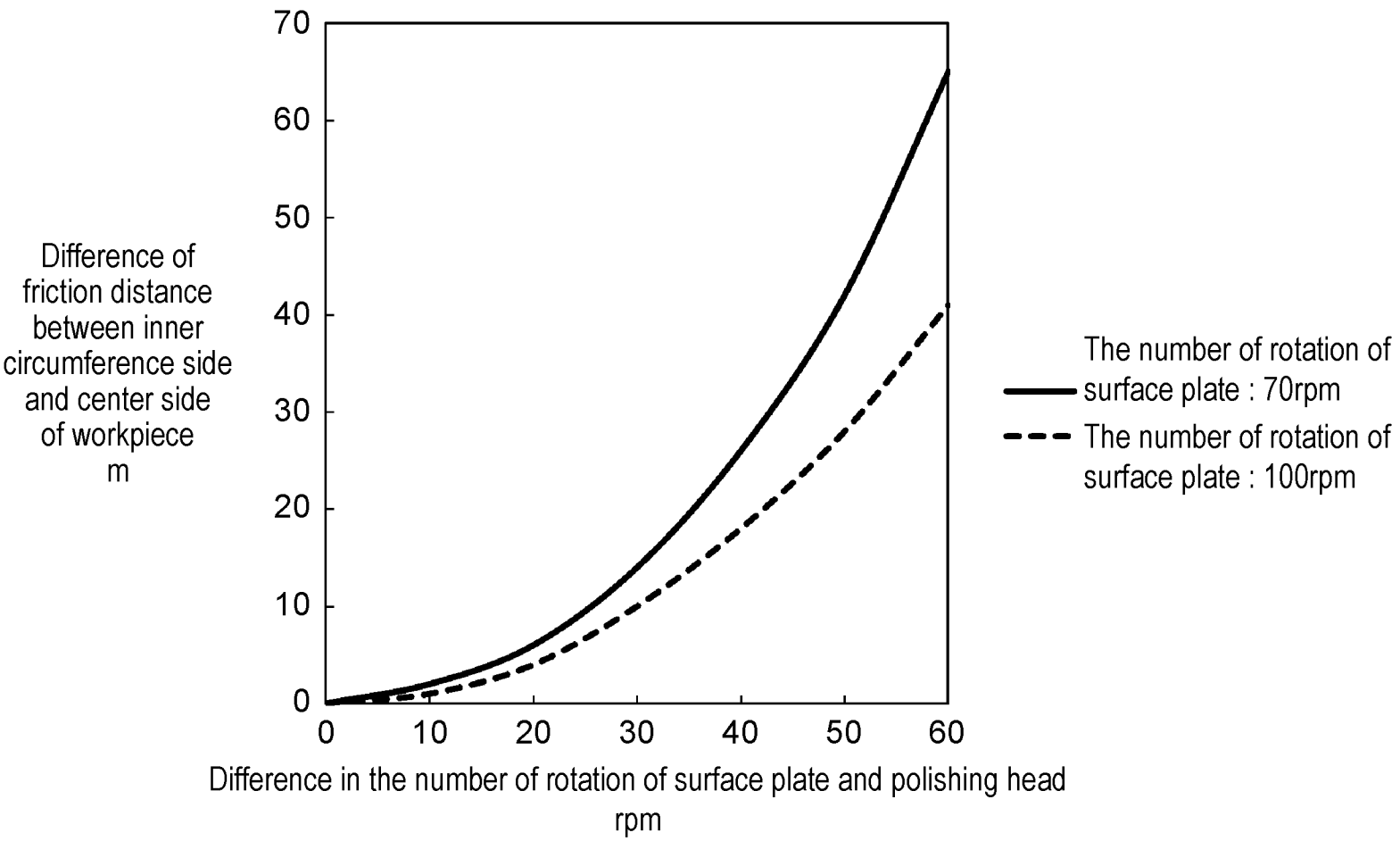
FIG. 5 is a graph showing a relationship of difference in the friction distance between the outer circumference side and a center side of a workpiece, and the difference in the number of rotation between a surface plate and the polishing head according to the embodiment of the disclosure.

FIG. 5 is a graph showing a relationship of the difference in the friction distance (time integral value of relative speed) between the outer circumference side and the center side of the workpiece, and the difference in the number of rotation of the surface plate and the polishing head.

In order to realize the shortening of the polishing time and the high flattening of the workpiece by evaluating the above-described temperature difference between the inner circumference side and the outer circumference side of the polishing head, a method for controlling the temperature distribution on the surface of the workpiece is required and description thereof will be described below.

As the method for controlling the temperature distribution on the surface of the workpiece, there is a method of providing the difference in the number of rotation between the surface plate and the polishing head. FIG. 5 shows that the distribution in the friction distance obtained by time-integrating the relative speed of the surface plate and the polishing head is maintained in the surface of the workpiece by setting the difference in the number of rotation in the number of rotation of the surface plate and the polishing head. Since the friction heat is proportional to the relative speed and the sliding time, the temperature distribution can be occurred on the surface of the workpiece by maintaining the distribution of the friction distance on the surface of the workpiece. In addition, even if the difference in the number of rotation is the same, by changing the number of rotation of either the surface plate or the polishing head (here, changing the number of rotation of surface plate), the amount of the difference in the friction distance is changed as shown by the solid line and the dotted line in FIG. 5.

Conversely, to make the temperature distribution on the workpiece surface uniform, by making the number of rotation of the surface plate and the polishing head the same, friction distance distribution becomes uniform and the temperature distribution in the surface of the workpiece due to the processing heat is made uniform.

In addition, the temperature distribution on the surface of the workpiece can be controlled by the temperature of the slurry to be supplied. As described above, since the slurry flows in from the outer circumference side of the workpiece toward the center, it is possible to decrease the temperature of the outer circumference side of the workpiece by decreasing the temperature of the slurry, and it is possible to suppress the decrease of the temperature in the outer circumference side of the workpiece by increasing the temperature of the slurry.

(Relationship Between Actual Measured Value and Set Value of the Number of Rotation of Surface Plate and Polishing Head)

Figure 10:
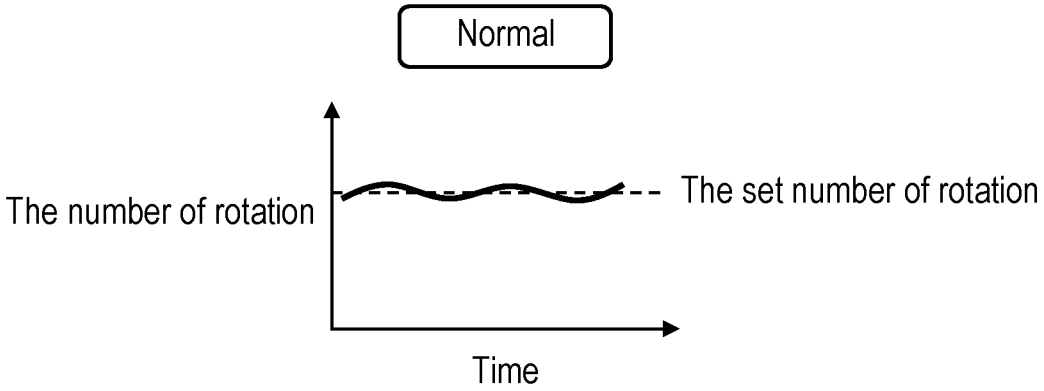
FIG. 10 is a graph showing the actual measured value of the number of rotation of the surface plate or the number of rotation of the polishing head, when the polishing device is operated normally.
Figure 11:
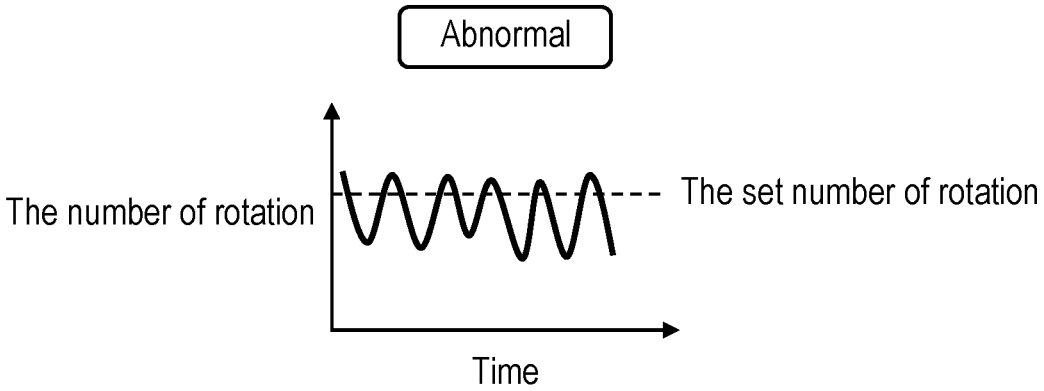
FIG. 11 is a graph showing the actual measured value of the number of rotation of the surface plate or the number of rotation of the polishing head, when an abnormality occurs in the polishing device.

Based on FIG. 10 and FIG. 11, a relationship between the actual measured value and the set value in the number of rotation of the surface plate and the polishing head will be described. FIG. 10 is a graph showing the actual measured value of the number of rotation of the surface plate or the number of rotation of the polishing head, when polishing device 10 is operated normally. FIG. 11 is a graph showing the actual measured value of the number of rotation of the surface plate or the number of rotation of the polishing head, when an abnormality occurs in polishing device 10.

As shown in FIG. 10, when polishing device 10 is operated normally, the difference between the number of rotation of the surface plate or the polishing head set by polishing condition setting unit 12 and the number of rotation of the surface plate or the polishing head measured by measuring unit 13 is lower than or equal to a predetermined threshold.

Meanwhile, as shown in FIG. 11, when an abnormality occurs in polishing device 10, the difference between the number of rotation of the surface plate or the polishing head set by polishing condition setting unit 12 and the number of rotation of the surface plate or the polishing head measured by measuring unit 13 is greater than a predetermined threshold. Specifically, as the cause of the abnormality, there are damage to the workpiece, lack of the slurry, contamination with foreign matter, surface roughness of the polishing pad, and the like. That is, when the difference between the actual measured value and the set value of the number of rotation is greater than a predetermined threshold, there is a high possibility that polishing resistance increases due to these causes. Therefore, in the present embodiment, an evaluation result obtained by evaluating the difference between the number of rotation of the surface plate and the polishing head is immediately fed back to polishing processing unit 11 of polishing device 10. When the polishing resistance increases, a solution to this problem is to replace polishing torque.

From the above, in the polishing system of the present embodiment, by using the change amount data of the rotational torque of the polishing head, the change amount data of the horizontal load of the polishing head, and the change amount data in the temperature difference between the inner circumference side and the outer circumference side of the polishing head as the state variables, the shortening of the polishing time and the high flattening are realized in the polishing process. In this case, since it is necessary to be fed back the evaluation result by evaluating the state variable in real time, it is preferable that the learning method of the condition correction model is a reinforcement learning method. The learning process of the condition correction model in learning unit 22 will be described.

(Outline of Learning Process)

Figure 6:
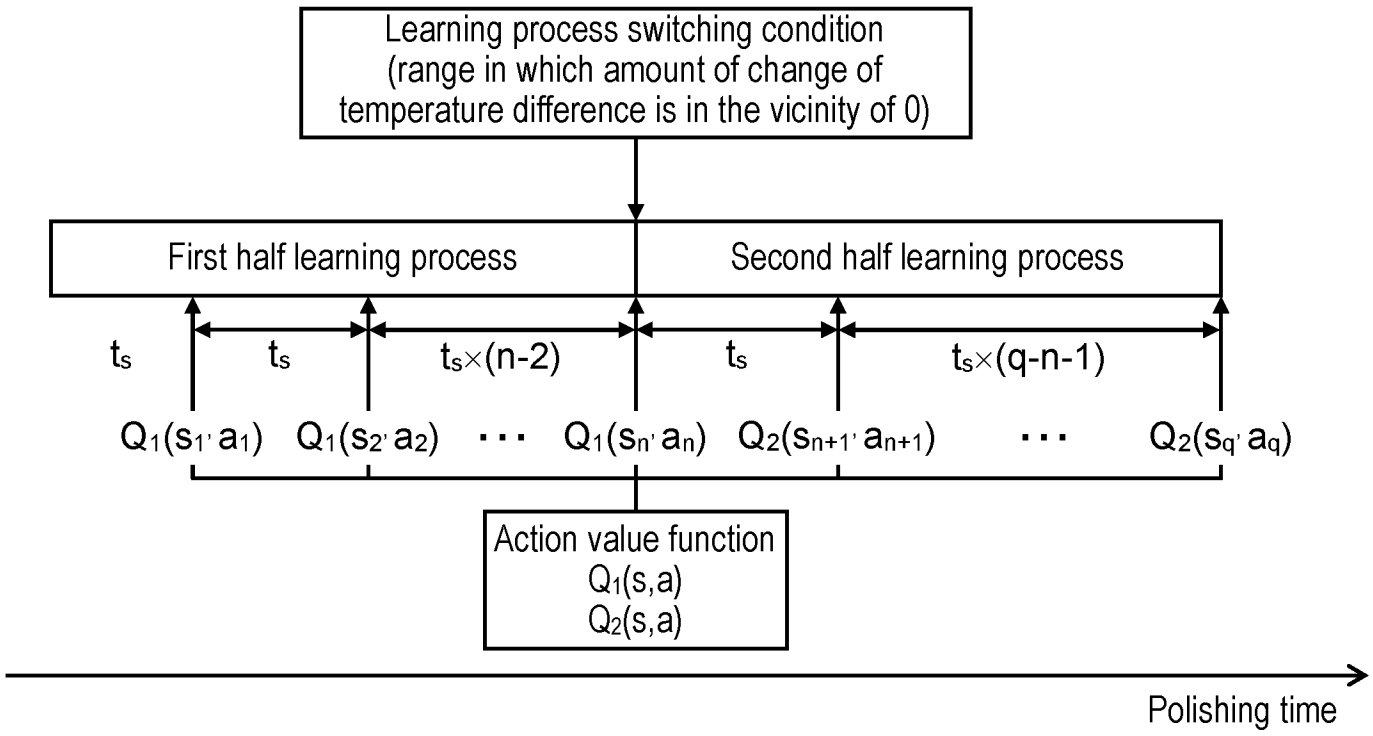
FIG. 6 is a diagram showing the outline of a learning process according to the embodiment of the disclosure.

FIG. 6 is a diagram showing the outline of the learning process in learning unit 22 of learning device 20.

The learning process is executed by the above-described learning unit 22. The learning process executed by learning unit 22 learns an optimal action value function Q (s, a) by using the reinforcement learning method. s is a parameter indicating a state and the above-described state variable, and a is a parameter indicating an action and a corrected polishing condition which is feedback-transmitted from correction polishing condition determination unit 25 to polishing device 10. When a desired result is obtained by the action of each value of the state variables, a reward r is given.

The learning process is divided into two learning processes of a first half learning process and a second half learning process in the finishing region in the above-described roughing region in FIG. 4. In the first half learning process and the second half learning process, each reward r is given differently, the optimal action value function $Q_1$ (s, a) is obtained in the first half learning process, and the optimal action value function $Q_2$ (s, a) is obtained in the second half learning process.

In the learning process, when the amount of change of the temperature difference between the inner circumference side and the outer circumference side of the polishing head falls within a range of 0 to a predetermined value within a sampling time (ts), the first half learning process is switched to the second half learning process. Here, the sampling time needs to evaluate the polishing process within this time, and, for example, is preferably approximately 1/10 of the total polishing time.

(First Half Learning Process)

Figure 7:
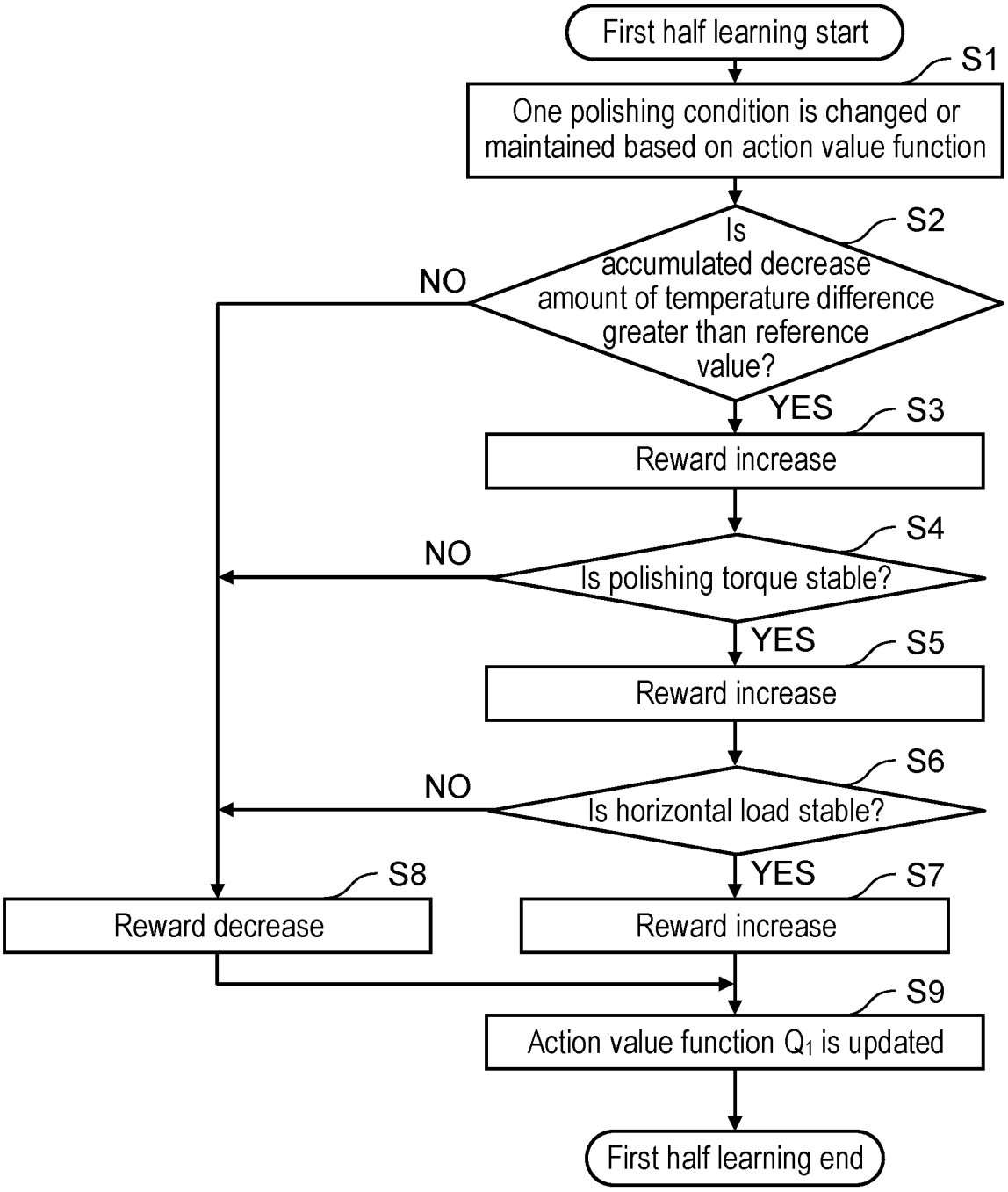
FIG. 7 is a flowchart showing a first half learning process according to the embodiment of the disclosure.

FIG. 7 is a flowchart of the first half learning process executed in learning processing unit 24 of the above-described learning unit 22 during the polishing on the workpiece.

First, in step S1, learning processing unit 24 selects at least one of a plurality of polishing conditions based on the action value function with a probability of 1−ε by using ε that is a value greater than or equal to 0 and smaller than or equal to 1, and increases, decreases, or maintains the value. Then, the polishing conditions are selected and the value is changed, randomly, with the probability of the remaining E. However, here, it is assumed that the slurry temperature cannot be changed among the polishing conditions. This is to make the temperature difference between the inner circumference side and the outer circumference side of the polishing head used in the process of step S2 described below due to variations in the thickness of the workpiece as much as possible.

Next, in step S2, learning processing unit 24 evaluates an accumulated value of the change amount data of the temperature difference between the inner circumference side and the outer circumference side of the polishing head, among the state variables, from the execution of the process of step S1 until the sampling time is reached, and proceeds the process to step S3 when it is determined that the accumulated decrease amount of the temperature difference is greater than a preset reference value. Meanwhile, when it is determined that the accumulated decrease amount of the temperature difference is not increased from the preset reference value, the process proceeds to step S8.

In step S3, learning processing unit 24 increases the reward r.

Next, in step S4, learning processing unit 24 evaluates the maximum value of the change amount data of the rotational torque of the polishing head and the average value thereof among the state variables from the execution of step S1 until the sampling time elapses, and when it is determined that each value is within a certain range with respect to a preset reference value, the process proceeds to step S5. Meanwhile, when it is determined that the maximum value of the change amount data of the rotational torque of the polishing head and the average value thereof are not within the certain range with respect to the preset reference value, the process proceeds to step S8.

Next, in step S5, learning processing unit 24 increases the reward r.

Next, in step S6, learning processing unit 24 evaluates the maximum value of the change amount data of the horizontal load of the polishing head and the average value thereof among the state variables from the execution of step S1 until the sampling time elapses, and when it is determined that each value is within a certain range with respect to the preset reference value, the process proceeds to step S7. Meanwhile, when it is determined that the maximum value of the change amount data of the horizontal load of the polishing head and the average value thereof are not within the certain range with respect to the preset reference value, the process proceeds to step S8.

Next, in step S7, learning processing unit 24 increases the reward r.

Next, in step S8, learning processing unit 24 decreases (or, maintains) the reward r.

Next, in step S9, learning processing unit 24 executes updating of the action value function $Q_1$ (s, a) by using a Q learning method. Since the action value function is a function that serves as a motive for action a, it is possible to obtain an optimal action a, that is, an optimal corrected polishing condition by the optimized action value function. Q learning is one of optimization methods of the action value function and updated by the following Equation (1).

$$Q(s_t,a_t) \leftarrow Q(s_t,a_t)+\alpha(r_{t+1}+\gamma \max_{\alpha_{t+1}} Q(s_{t+1},a_{t+1})-Q(s_t, a_t)) \quad \text{Equation (1)}$$

Here, $s_t$ is a state s in time t, and $a_t$ is action a in time t. The action $a_t$ is shifted to the next state $s_{t+t}$, and the reward $r_{t+1}$ is obtained there. α is a parameter called as a learning rate greater than or equal to 0 and smaller than or equal to 1 and γ is a parameter called as a discount rate greater than or equal to 0 and smaller than or equal to 1. The term with max is the action value function that becomes the maximum in the next state, and the action value function is optimized by this term and the term of reward.

By repeatedly executing the first half learning process by learning processing unit 24, the action value function is optimized and the action a is executed so that the reward r is maximized. Therefore, correction polishing condition determination unit 25 can determine the corrected polishing condition that is a condition for correcting the current polishing condition, based on the state variables and the action value function optimized by a first half learning processing unit.

Each determination process of the above-described steps S2, S4, and S6 may omit other determination processes as long as at least one of the determination processes is executed. In addition, when the determination process is omitted, an increase process and a decrease process of the reward based on a result of the determination process may be omitted.

(Second Half Learning Process)

Figure 8:
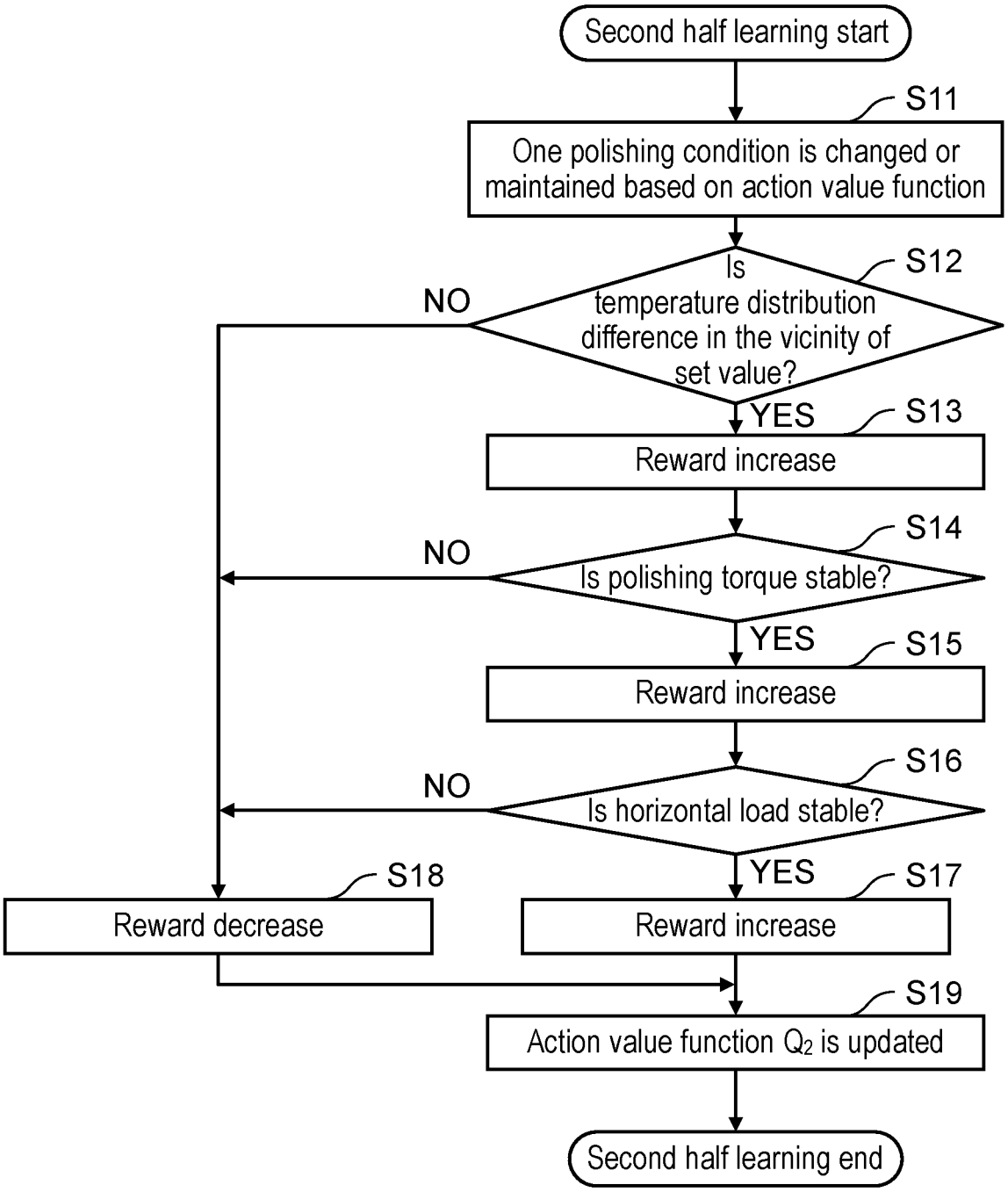
FIG. 8 is a flowchart showing a second half learning process according to the embodiment of the disclosure.

FIG. 8 is a flowchart of the second half learning process on the workpiece during the polishing executed in learning processing unit 24 of the above-described learning unit 22. The flowchart is basically the same flowchart as the first half learning process shown in FIG. 7, and the difference from FIG. 7 is the determination condition in the process of step S12. In the following description, description of processing steps for executing the same processing as that in FIG. 7 is omitted.

First, learning processing unit 24 executes the process of step S11. The present process is the same process as that of the above-described step S1.

Next, in step S12, learning processing unit 24 evaluates an accumulated value of the change amount data in the temperature difference between the inner circumference side and the outer circumference side of the polishing head among the state variables from the execution of the process of step S11 until the sampling time, and when it is determined that the temperature difference is within a preset reference range, the process proceeds to step S13. Meanwhile, when it is determined that the temperature difference is not within the preset reference range, the process proceeds to step S18.

Next, learning processing unit 24 executes the process of step S13. The present process is the same process as that of the above-described step S3.

Next, learning processing unit 24 executes the process of step S14. The present process is the same process as that of the above-described step S4.

Next, learning processing unit 24 executes the process of step S15. The present process is the same process as that of the above-described step S5.

Next, learning processing unit 24 executes the process of step S16. The present process is the same process as that of the above-described step S6.

Next, learning processing unit 24 executes the process of step S17. The present process is the same process as that of the above-described step S7.

Next, learning processing unit 24 executes the process of step S18. The present process is the same process as that of the above-described step S8.

Next, in step S19, learning processing unit 24 executes the updating of the action value function $Q_2$ (s, a) by the Q learning method. The present process is the same process as that of the above-described step S9.

By repeatedly executing the second half learning process by learning processing unit 24, the action value function is optimized and the action a is executed so that the reward r is maximized. Therefore, correction polishing condition determination unit 25 can determine the corrected polishing condition that is a condition for correcting the current polishing condition, based on the state variables and the action value function optimized by a second half learning processing unit.

Each determination process of the above-described step S12, S14, and S16 may omit other determination processes as long as at least one of the determination processes is executed. In addition, when the determination process is omitted, an increase process and a decrease process of the reward based on a result of the determination process may be omitted.

Figure 9:
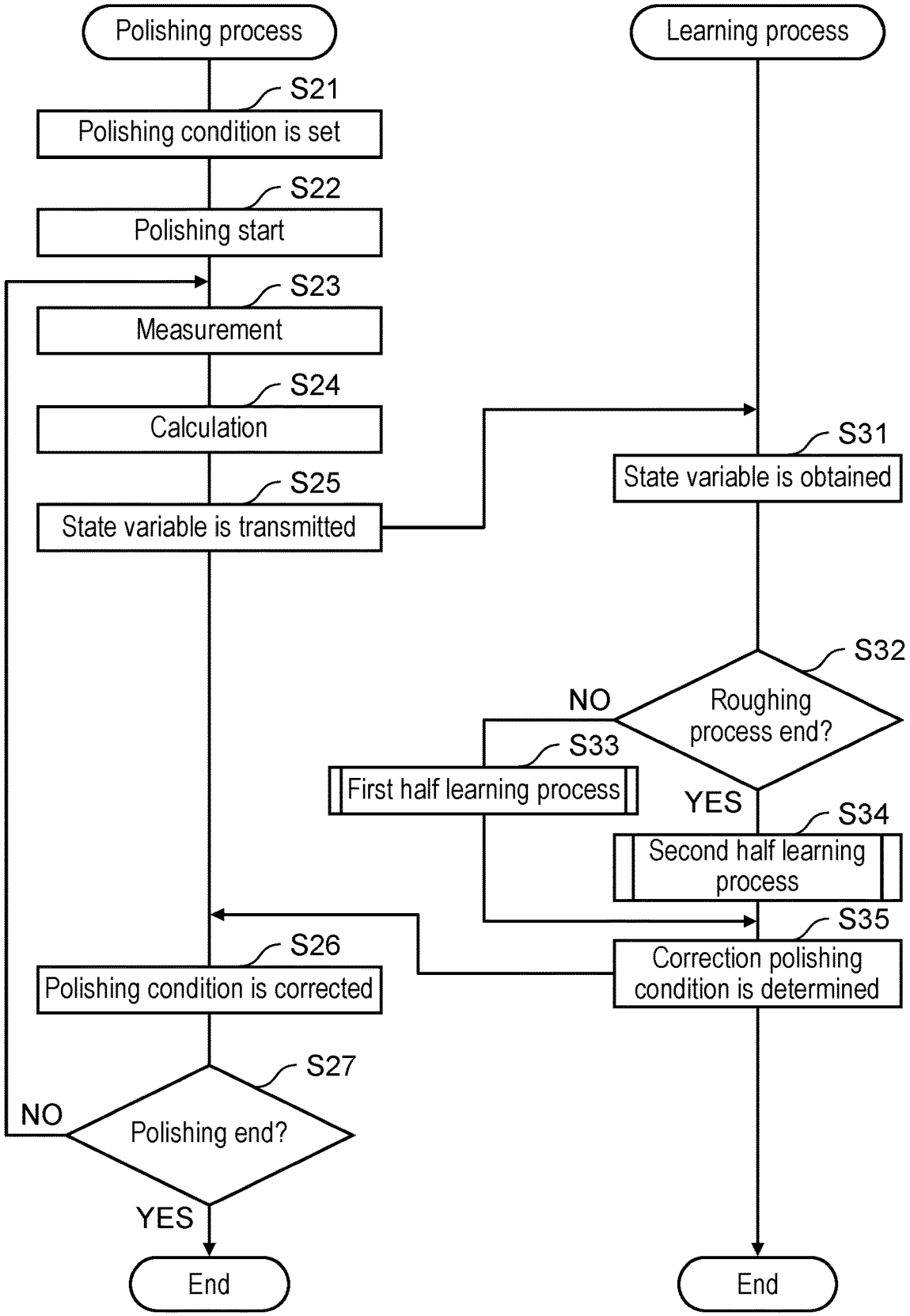
FIG. 9 is a flowchart showing a process executed by a polishing device and a learning device including a polishing system according to the embodiment.

Next, based on FIG. 9, a process executed by a polishing system 1 according to the present embodiment will be described. FIG. 9 is a flowchart showing an example of a process executed by polishing device 10 and learning device 20 included in polishing system 1 according to the present embodiment.

As shown in FIG. 9, polishing condition setting unit 12 of polishing device 10 sets the polishing condition (S21). In addition, polishing condition setting unit 12 stores the polishing condition data indicating the set polishing condition in state variable storage unit 15. Polishing processing unit 11 starts the polishing based on the set polishing condition (S22). Measuring unit 13 obtains various data from each sensor and generates the measurement data, during the polishing (S23). Measuring unit 13 outputs the generated measurement data to state calculating unit 14. State calculating unit 14 executes a calculation process with respect to the obtained measurement data, and generates the change amount data (S24). State calculating unit 14 stores the generated change amount data in state variable storage unit 15. State variable storage unit 15 transmits the newly stored state data to learning device 20 (S25). Learning device 20 completes the polishing condition correction process.

When state variable receiving unit 21 of learning device 20 receives the state data (S31), state variable receiving unit 21 outputs the received state data to learning unit 22. Learning unit 22 determines whether or not the roughing process completes (S32). When the roughing process is not completed (NO in S32), learning processing unit 24 executes the first half learning process (S33). Meanwhile, when the roughing process is completed (YES in S32), learning processing unit 24 executes the second half learning process (S34). Correction polishing condition determination unit 25 determines the corrected polishing condition corresponding to the state variables during the polishing, based on the updated action value function (S35). Correction polishing condition determination unit 25 transmits the corrected polishing condition data indicating the determined corrected polishing condition to polishing device 10.

When polishing device 10 receives the corrected polishing condition data from learning device 20, polishing processing unit 11 corrects the polishing condition, based on the received corrected polishing condition data (S26). Polishing processing unit 11 executes the polishing under the corrected polishing condition. Here, when the polishing is not completed (NO in S27), measuring unit 13 generates the measurement data again (S23). Meanwhile, when the polishing is completed (YES in S27), polishing device 10 completes the polishing process.

Learning device 20 may not execute the first half learning process or the second half learning process every time the state data is received. In other words, before starting the polishing condition correction process, learning device 20 may complete the learning process, and may execute the polishing condition correction process based on the updated action value function.

According to the disclosure, in the polishing process, it is possible to feed back the corrected polishing condition obtained by each of the measurement data and the polishing condition to the polishing device in real time. In addition, since the action value function for executing the correction of the polishing condition by learning unit 22 is optimized, it is possible to realize a stable polishing process in real time.

The polishing system of the disclosure includes a polishing device that applies a load by a polishing head to a workpiece on a polishing pad of a surface plate, supplies slurry onto the polishing pad, and executes polishing on the workpiece by rotating each of the surface plate and the polishing head, and a learning device that executes learning on the polishing device, in which in the learning device, a state information receiving unit that receives state information including at least one polishing condition relating to the polishing, and a calculation result calculated based on at least one measured value measured during the execution of the polishing, and a learning unit that executes learning for determining a corrected polishing condition for correcting the polishing condition by updating an action value function for determining an action value for correcting the polishing condition based on the state information, are included.

In addition, in the polishing system of the disclosure, the polishing device may include a torque measuring unit that measures a rotational torque of the polishing head during the execution of the polishing, and the at least one measured value may include the rotational torque of the polishing head during the execution of the polishing.

In addition, in the polishing system of the disclosure, the polishing device may include a load measuring unit that measures a load in a horizontal direction acting on the polishing head during the execution of the polishing, and the at least one measured value may include the load in the horizontal direction acting on the polishing head during the execution of the polishing.

In addition, in the polishing system of the disclosure, the polishing device may include a temperature measuring unit that measures temperatures of the polishing head at at least two or more points during the execution of the polishing, and the at least one measured value may include the temperatures generated in the polishing head during the execution of the polishing.

In addition, in the polishing system of the disclosure, the polishing device may include a time measuring unit that measures an elapsed time from start of the polishing on the same polishing pad, and the at least one measured value may include the elapsed time from the start of the polishing.

In addition, a learning device of the disclosure for executing learning on a polishing device by applying a load by a polishing head to a workpiece on a polishing pad of a surface plate, supplying slurry onto the polishing pad, and executing polishing on the workpiece by rotating each of the surface plate and the polishing head, includes a state information receiving unit that receives state information including at least one polishing condition relating to the polishing, and a calculation result calculated based on at least one measured value measured during the execution of the polishing, and a learning unit that executes learning for determining a corrected polishing condition for correcting the polishing condition by updating an action value function for determining an action value for correcting the polishing condition based on the state information.

In addition, a learning method of a learning device of the disclosure for executing learning on a polishing device by applying a load by a polishing head to a workpiece on a polishing pad of a surface plate, supplying slurry onto the polishing pad, and executing polishing on the workpiece by rotating each of the surface plate and the polishing head, includes receiving state information including at least one polishing condition relating to the polishing, and a calculation result calculated based on at least one measured value measured during the execution of the polishing, and executing learning for determining a corrected polishing condition for correcting the polishing condition by updating an action value function for determining an action value for correcting the polishing condition based on the state information.

According to the disclosure, since it is possible to evaluate a state of the polishing process based on real-time data generated during the polishing of the workpiece, it is possible to stabilize the polishing process.

What is claimed is:

1. A polishing system comprising:

a polishing device that applies a load by a polishing head to a workpiece on a polishing pad of a surface plate, supplies slurry onto the polishing pad, and executes polishing on the workpiece by rotating each of the surface plate and the polishing head; and a learning device that corrects the polishing executed by the polishing device through learning, wherein the learning device includes a state information receiving unit that receives state information including (i) at least one polishing condition relating to the polishing, and (ii) a calculation result calculated based on at least one measured value related to a condition of the polishing head measured during execution of the polishing, a learning unit that updates, based on the state information during the polishing, an action value function in which the state information and a corrected polishing condition for correcting the polishing condition are associated with each other, and a determination unit that determines the corrected polishing condition corresponding to the state information during the polishing, based on the action value function updated by the learning unit, and transmits via a wired or wireless connection corrected polishing data based on the corrected polishing condition determined for controlling the polishing device to execute corrected polishing on the workpiece using the corrected polishing data in real-time.

2. The polishing system of claim 1, wherein the polishing device includes a torque measuring unit that measures a rotational torque of the polishing head during the execution of the polishing, and the at least one measured value includes the rotational torque of the polishing head during the execution of the polishing.

3. The polishing system of claim 1, wherein the polishing device includes a load measuring unit that measures a load in a horizontal direction acting on the polishing head during the execution of the polishing, and the at least one measured value includes the load in the horizontal direction acting on the polishing head during the execution of the polishing.

4. The polishing system of claim 1, wherein the polishing device includes a temperature measuring unit that measures temperatures of the polishing head at at least two or more points during the execution of the polishing, and the at least one measured value includes the temperatures generated in the polishing head during the execution of the polishing.

5. The polishing system of claim 1, wherein the polishing device includes a time measuring unit that measures an elapsed time from start of the polishing on the same polishing pad, and the at least one measured value includes the elapsed time from the start of the polishing.

6. A learning device that corrects, through learning, polishing on a workpiece executed by a polishing device by applying a load by a polishing head to the workpiece on a polishing pad of a surface plate, supplying slurry onto the polishing pad, and rotating each of the surface plate and the polishing head, the learning device comprising:

a state information receiving unit that receives state information including (i) at least one polishing condition relating to the polishing, and (ii) a calculation result calculated based on at least one measured value related a condition of the polishing head measured during execution of the polishing;

a learning unit that updates an action value function in which the state information and a corrected polishing condition for correcting the polishing condition are associated with each other, based on the state information during the polishing; and a determination unit that determines the corrected polishing condition corresponding to the state information during the polishing, based on the action value function updated by the learning unit and transmits via a wired or wireless connection corrected polishing data based on the corrected polishing condition determined for controlling the polishing device to execute corrected polishing on the workpiece using the corrected polishing data in real-time.

7. A learning method of a learning device that corrects, through learning, polishing on a workpiece executed by a polishing device by applying a load by a polishing head to the workpiece on a polishing pad of a surface plate, supplying slurry onto the polishing pad, and rotating each of the surface plate and the polishing head, the learning method comprising:

receiving state information including (i) at least one polishing condition relating to the polishing, and (ii) a calculation result calculated based on at least one measured value related to a condition of the polishing head measured during execution of the polishing;

updating an action value function in which the state information and a corrected polishing condition for correcting the polishing condition are associated with each other, based on the state information during the polishing;

determining the corrected polishing condition corresponding to the state information during the polishing, based on the updated action value function; and transmitting via a wired or wireless connection corrected polishing data based on the corrected polishing condition determined for controlling the polishing device to execute corrected polishing on the workpiece using the corrected polishing data in real-time.

* * * * *